United States Patent [19]

Fuhri

[11] 4,372,630

[45] Feb. 8, 1983

[54] PORTABLE EASEL DEVICE

[76] Inventor: William F. Fuhri, R.R. 5, Box 94, Liberty, Mo. 64068

[21] Appl. No.: 206,947

[22] Filed: Nov. 14, 1980

[51] Int. Cl.[3] ..... A47B 97/04

[52] U.S. Cl. ..... 312/231; 312/230; 312/232; 206/1.7; 248/188; 248/461

[58] Field of Search ..... 312/231, 232, 233, 230; 206/1.7, 1.8; 248/461, 188

[56] References Cited

U.S. PATENT DOCUMENTS

| | | | |
|---|---|---|---|
| 213,166 | 3/1879 | Brownell | 312/231 |
| 1,086,735 | 2/1914 | Spaulding | 206/1.7 |
| 2,372,077 | 3/1945 | Glinecki . | |
| 2,586,524 | 2/1952 | Dussardier | 312/231 |
| 2,638,397 | 5/1953 | Wykoff | 312/231 |
| 2,751,271 | 6/1956 | Dessertenne et al. | 312/231 |
| 3,168,363 | 2/1965 | Monsour | 312/231 |
| 3,202,471 | 8/1965 | Wilson | 312/231 |
| 3,273,700 | 9/1966 | Moreau et al. | 206/1.7 |
| 3,378,322 | 4/1968 | Johnson | 312/231 |
| 3,476,456 | 11/1969 | Canavan | 312/231 |
| 3,669,227 | 6/1972 | Alford | 312/231 |
| 4,047,774 | 9/1977 | Hanning | 312/231 |
| 4,061,224 | 12/1977 | Fuhri | 206/1.7 |
| 4,093,326 | 6/1978 | Ford | 312/231 |
| 4,149,763 | 4/1979 | Delahaie | 248/461 |

FOREIGN PATENT DOCUMENTS

| | | | |
|---|---|---|---|
| 675919 | 2/1930 | France | 312/231 |
| 1031880 | 6/1953 | France | 206/1.7 |
| 1450682 | 7/1966 | France | 248/461 |
| 1119347 | 7/1968 | United Kingdom | 312/231 |

OTHER PUBLICATIONS

A catalog page from "Van Dyke Artists Easels" by Eberhard Faber Inc.

*Primary Examiner*—Victor N. Sakran

*Attorney, Agent, or Firm*—Kokjer, Kircher, Bradley, Wharton, Bowman & Johnson

[57] ABSTRACT

A device which serves alternatively as an easel and as a drawing board and which provides a carrying case for art supplies and the components of the easel and support legs. The easel can be set up in the lower section of the case and is supported by a rigid triangular framework formed by the upper and lower sections of the case and a folding easel arm. The drawing board is located on the upper section. A reversible hinge arrangement permits the hinge connection between the upper and lower sections to be reversed for drawing. Strategically located compartments within the upper and lower sections make the painting supplies conveniently accessible for painting and the drawing supplies conveniently accessible for drawing. The legs can be broken down for storage in the case and have a male-female joint for increased strength and stability.

16 Claims, 5 Drawing Figures

PORTABLE EASEL DEVICE

BACKGROUND AND SUMMARY OF THE INVENTION

This invention relates in general to a multiple purpose device which serves as an easel, a drawing board, and as a carrying case for art supplies and the like.

My prior U.S. Pat. No. 4,061,224 is directed to a carrying case for art supplies which also provides a drawing board upon which drawings and sketches can be made. Although this case has proven to be highly convenient, it does not provide an easel and it is necessary for a separate easel to be used when painting is undertaken. Thus, an artist who may be drawing at times and painting at other times must take with him both the carrying case and a portable easel for use when painting.

Various types of portable easel devices have been proposed, including a device commonly known as a French easel. The French easel includes a tripod arrangement and a carrying case which unfolds to provide an adjustable easel. The primary drawback with the French easel is that it is a highly complicated and bulky device that requires a number of complex operations in order to set it up and take it down. Its complexity also makes the French easel so expensive as to be nearly prohibitive for most artists. The French easel is also rather awkward and difficult to carry in the folded position because the legs and the components of the easel structure are located on the exterior of the case where they can snag on clothes and other obstructions.

Another problem with the French easel is that the legs are lacking somewhat in strength and stability, particularly when they are fully extended or nearly fully extended as they normally are during use. As a result, the easel is susceptible to shaking and wobbling when it is supported on the legs. In the French easel, the painting supplies are not conveniently located in a storage area which is readily accessible to the artist working at the easel. Perhaps even more significantly, the French easel lacks a drawing board, and it is thus necessary to provide a separate drawing board if drawing or sketching is to be performed.

The present invention is aimed at eliminating the problems associated with French easels and other portable easel devices and has, at its principal goal, the provision of a versatile device which serves as a carrying case for art supplies and which also provides both an easel and a drawing board.

More specifically, it is an object of the invention to provide a portable easel device in which the legs and the components of the easel fold up in a manner to be conveniently stored in the carrying case.

Another object of the invention is to provide a portable easel device wherein the easel is readily adjustable as to its inclination and the size of the canvas it supports.

An additional object to the invention is to provide a portable easel device wherein the easel can be quickly and easily set up and taken down.

Still another object of the invention is to provide a portable easel device having a drawing board and a unique reversible hinge arrangement which permits the drawing board to be positioned on the same side of the case as the easel. Painting and drawing or sketching can thus be carried out from the same side of the device without interference from the third leg of the tripod leg structure.

A further object of the invention is to provide a portable easel device of the character described wherein the painting supplies are conveniently located relative to the easel and the drawing are conveniently located relative to the drawing board. Unlike the French easel and other known devices, the carrying case of the present invention provides compartments holding painting supplies immediately in front of the easel and compartments holding drawing supplies immediately in front of the drawing board. Consequently, the appropriate supplies are in an accessible location for both painting and drawing.

Yet another object of the invention is to provide, in a portable easel device of the character described, a sliding drawer for holding painting and drawing supplies on the side from which both painting and drawing are performed. The drawer can hold a folding palette and other painting supplies as well as drawing paper and other drawing supplies. Since the drawer is located on the same side of the device as the artist, its contents are readily accessible at all times. Additionally, the reversible box which is carried in the drawer permits the appropriate supplies to be conveniently positioned in relation to the artist.

A still further object of the invention is to provide a portable easel device wherein the upper section of the carrying case is a more functional part of the device than it is in French easels and other devices in which the upper section serves merely as a cover. In the present invention, the upper section provides the drawing board and the compartments that hold the drawing supplies, as well as serving as an easel support.

An additional object of the invention is to provide, in a portable easel device of the character described, an improved leg structure which enhances the strength of the legs and the overall stability of the device and which permits the leg to be quickly and easily folded up and disassembled for storage in the carrying case. The male-female joint provided between the upper and intermediate leg sections increases the rigidity of the legs and prevents wobbling and other unsteadiness of the easel and drawing board during use.

Still another object of the invention is to provide a portable easel device which is simple and economical to construct and which can be supported either on the tripod legs or on a table or similar surface.

Other and further objects of the invention, together with the features of novelty appurtenant thereto, will appear in the course of the following description.

DETAILED DESCRIPTION OF THE INVENTION

In the accompanying drawings, which form a part of the specification and are to be read in conjunction therewith and in which like reference numerals are used to indicate like parts in the various views.

Figures 1, 5:
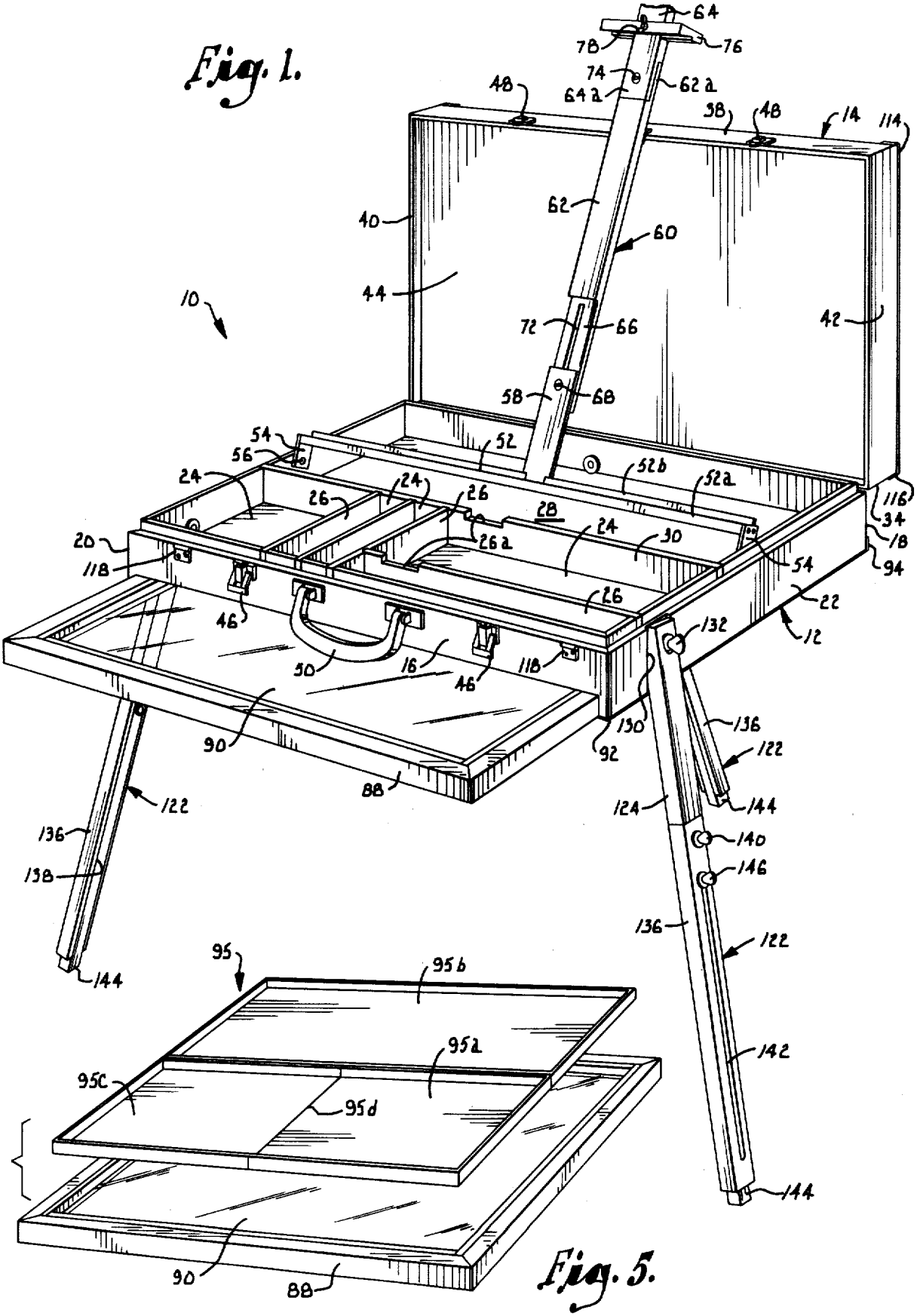
FIG. 1 is a perspective view of a portable easel device constructed according to a preferred embodiment of the present invention, with the easel set up to receive a painting canvas and the sliding drawer partially open.
FIG. 5 is an exploded perspective view of a compartmentized box which can be used to hold painting and drawing supplies and showing the manner in which the box fits in the sliding drawer.

Referring now to the drawings in more detail and initially in FIG. 1, numeral 10 generally designates a portable easel device constructed in accordance with the present invention. The portable easel device includes a carrying case having a lower section 12 and an upper section 14. The lower section 12 has front and back end walls 16 and 18 and opposite side walls 20 and 22 which are interconnected to provide a generally rectangular, box-like configuration. A flat floor panel 23 of the lower section extends between its walls. Within the lower section of the carrying case, a plurality of separate compartments 24 are formed by partitions 26 which are secured in the lower section. A pair of transverse partitions are provided with aligned notches 26*a* which serve a purpose that will be made clear. A relatively large compartment 28 is formed behind a transverse partition 30 which extends completely across the width of the lower section at a location somewhat forward of the center line. One of the notches 26*a* is formed in partition 30. The large compartment is suitable for holding art supplies such as a palette or drawing paper and also serves as a storage compartment for storing the components of the portable easel and legs, as will be explained more fully.

The upper section 14 of the carrying case connects with the lower section 12 in hinged fashion. The back wall 18 of lower section 12 is provided with a pair of spaced apart hinge barrels 32 (see FIG. 3). The back wall 34 of upper section 14 is provided with a pair of spaced apart hinge pins 36 which may be fitted in the hinge barrels 32. In this manner, the upper section 14 is connected with the lower section 12 for hinged movement between an open position of the case (FIG. 1) and a closed position wherein upper section 14 covers lower section 12. The hinge pins 36 may be removed from hinge barrels 32 by shifting the upper section 14 to one side, thereby detaching the upper section from the lower section of the case.

Upper section 14 has, in addition to the back wall 34, a front wall 38 and opposite side walls 40 and 42 which are interconnected to form a rectangular, box-like structure. The upper section has a floor panel 44 which is raised somewhat above the bottom edges of the side and end walls and which rests on the upper edges of the partitions 26 and 30 in the lower section when the case is closed. Latch elements 46 are provided on the front wall 16 of the lower section and engage latch components 48 on wall 38 of the upper section to secure the case in the closed position. A handle 50 is provided on wall 16 for convenient carrying of the case.

The carrying case is equipped with an easel having a canvas rest 52 at the bottom. The canvas rest 52 extends substantially between walls 20 and 22 and is connected with the lower section 12 for pivotal movement between an extended position exemplified by the solid line view of FIG. 3 and a folded storage position shown in broken lines in FIG. 3. A pair of metal lugs 54 are screwed or otherwise secured to opposite ends of the canvas rest 52. Lugs 54 are pivotally connected at their opposite ends with side walls 20 and 22 by pivot pins 56. In its extended position, canvas rest 52 projects out of the lower section of the case and presents a generally horizontal surface 52*a* for receiving the lower edge of a painting canvas positioned on the easel. The canvas rest has a lip 52*b* which projects upwardly beyond surface 52*a* from its rear edge.

The canvas rest 52 has a short arm 58 projecting from its center generally perpendicular to surface 52*a* and coplanar with lip 52*b*. Arm 58 is inclined somewhat to the rear of vertical when the canvas rest is in its extended position and is received in notches 26*a* in the storage position of the canvas rest, as best shown in broken lines in FIG. 3. The canvas rest, including arm 58, is thus located completely within lower section 12 of the carrying case in the storage position.

Figure 3:
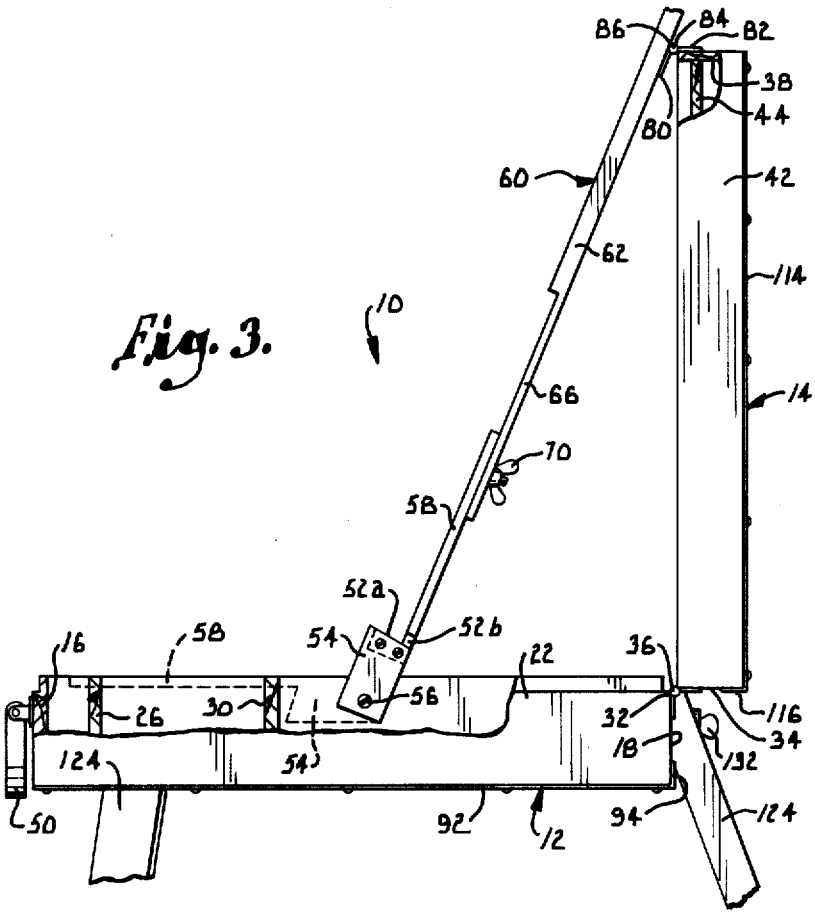
FIG. 3 is a fragmentary side elevational view of the device with the easel set up, portions being broken away for illustrative purposes and the broken lines indicating movement of the canvas support to its storage position.

The easel structure also includes an elongate easel arm 60 having a lower section 62 and an upper section 64 which are approximately equal in length. As best shown in FIG. 1, the lower section 62 is reduced in thickness at its lower end as indicated at 66. Arm 58 of the canvas rest overlaps with portion 66 and may be secured thereto by a screw 68 and wing nut 70 (FIG. 3). Portion 66 has an elongate slot 72 through which screw 69 extends. By loosening the wing nut 70, the easel arm 60 can be extended or retracted with respect to arm 58 to adjust the effective length of the easel arm, with screw 68 moving in slot 72 during the adjustment. Wing nut 70 can be removed to permit detachment of arm 60 from arm 58 when the easel is to be stored.

The upper end of arm section 62 and the lower end of arm section 64 are reduced in thickness as indicated at 62*a* and 64*a*, respectively. The reduced portions 62*a* and 64*a* overlap one another and are connected by a screw 74 which receives a nut (not shown). The arm section 62 and 64 thus cooperate to provide a straight easel arm when the easel is set up. By loosening the nut (not shown) on screw 74, arm section 64 can be folded such that it extends alongside section 62 for storage. The arm sections are short enough that when folded they can be stored within the large storage compartment 28 in the lower section 12.

The easel arm 60 has a dovetail cross section in order to receive a bracket 76 having a dovetail groove therein. The bracket 76 is adjustable along the length of the easel arm and may be fixed in the desired position thereon by tightening a set screw 78 having a wing nut finger grip. The lower surface of bracket 76 engages the upper edge of the painting canvas to assist in holding the canvas in place. The back of the canvas rests on the easel arm 60 and the arm 58 which projects from the canvas rest.

As shown in FIG. 3, the lower section 62 of the easel arm is provided on its back surface with a small mounting plate 80, while the front wall 38 of upper section of the carrying case is provided with a similar plate 82. Plate 82 carries a barrel which fits between a pair of barrels on plate 80 in the position of FIG. 3 to form a continuous barrel 84 which receives a removable pin 86 in order to connect the easel arm with the upper section 14 of the carrying case. The easel is thus maintained firmly in position by the triangular structure defined by the easel arm, the upper section 14 of the carrying case, and the rearward portion of the lower section 12. This rigid triangular structure is best shown in FIG. 3. By extending or retracting easel arm 60 relative to arm 58 of the canvas rest, the effective length of the easel arm and its angle of inclination relative to vertical can be varied in order to hold the painting canvas at the desired position. Bracket 76 can be stored in the carrying case on the easel arm 60, or it can be detached from the easel and stored separately in compartment 28.

The lower section 12 of the carrying case has a sliding drawer 88 which is received in a cavity formed in the bottom of the lower section below panel 23. The drawer 88 has an open interior region which holds art supplies such as a folding palette or drawing paper. Drawer 88 has a transparent bottom panel 90 which is constructed of plexiglass or the like and which forms the bottom of the carrying case. A painting, drawing or other object can be placed face down on panel 90 such that it is displayed through the transparent panel when the case is carried. Drawer 88 is supported sliding movement on a pair of metal flanges 92 which are secured to the bottom edges of side walls 20 and 22 of the lower section. The flanges 92 project inwardly of the side walls in order to receive the opposite edges of the drawer. The rearward ends of flanges 92 are turned upwardly to form stops 94 which prevent drawer 88 from sliding out the back of the lower section. Flanges 92 support drawer 88 for sliding movement between the open position shown in FIG. 1 and the closed position shown in FIG. 2. In the open position of the drawer, its contents are readily accessible to the artist working from the front of the unit, while the drawer is retracted completely within section 12 when closed. A latch (not shown) is provided to releasably hold drawer 88 in the closed position.

FIG. 5 illustrates a compartmentized box 95 which is generally rectangular and which is sized to fit closely within drawer 88. Box 95 has vertical side and end walls and a central partition **95*a* across its width to divide the box interior into separate components 95*b* and 95*c*. Compartment 95*b* normally holds drawing supplies, while the other compartment 95*c* serves as a palette which holds oil paints. It is contemplated that compartment 95*c* will be constructed in a manner to fold over on itself about an axis defined by fold line 95*d*, thus enclosing the oil paints within the folded compartment 95*c* to prevent the paint from running out of box 95 during carrying of the case. Box 95 can be oriented in the drawer 88 such that compartment 95*b* is toward the front of the case for drawing or compartment 95*c* is toward the front of the case for painting. The compartment which is located toward the front of the case is exposed when drawer 88** is partially open.

Figure 2:
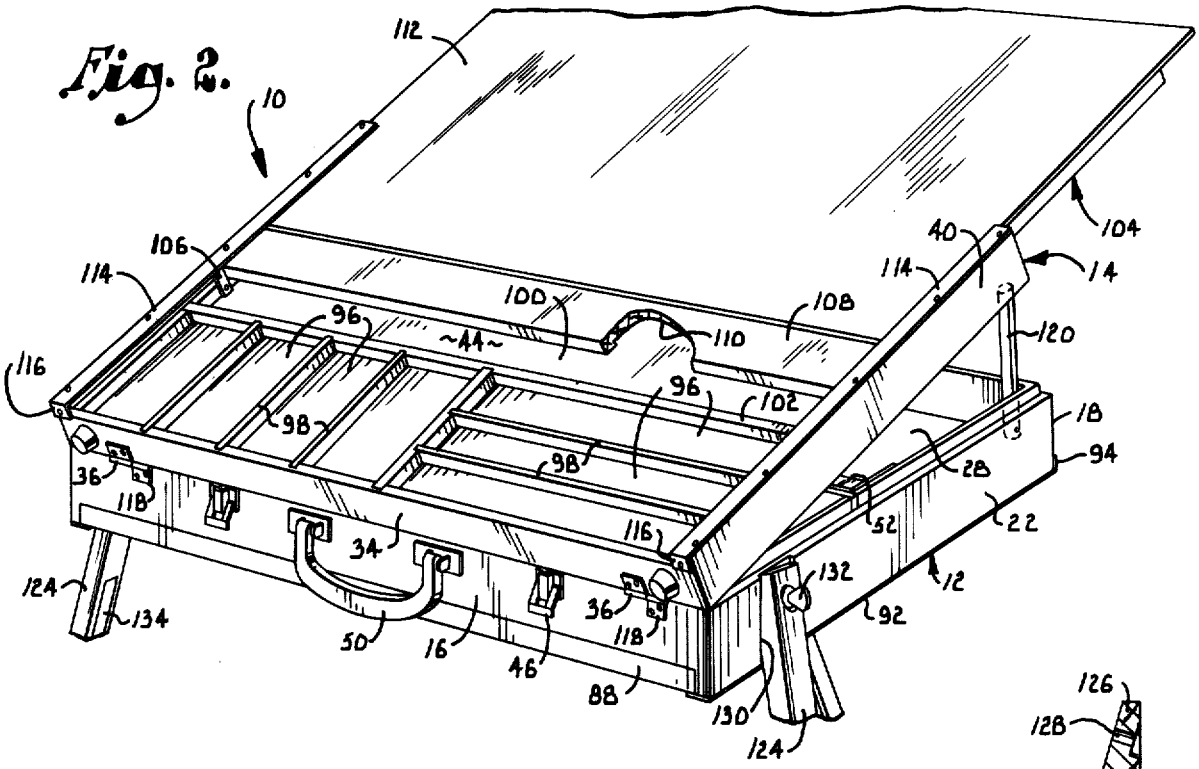
FIG. 2 is a fragmentary prospective view of the portable easel device, with the upper section positioned to permit drawing to be performed on the drawing board and with a portion broken away for purposes of illustration.

Referring particularly to FIG. 2, the upper section 14 of the carrying case has an interior region above the floor panel 44 which is divided into a plurality of compartments 96 by partitions 98. The compartments 96 are located adjacent to the back wall 34 of the upper section and are suitable for holding drawing supplies such as charcoal, pencils and erasers. A large compartment 100 is presented beyond a transverse partition 102 which extends between the side walls 40 and 42 of the upper section. Compartment 100 is large enough to hold drawing paper, as well as other drawing supplies.

The upper section 14 of the carrying case is equipped with a flat drawing board 104. The drawing board 104 is supported for sliding movement on the upper section between a closed or storage position and an open or working position. In the storage position, the drawing board 104 covers compartments 96 and 100, while compartments 96 are exposed in the working position of the drawing board shown in FIG. 2. A pivotal latch 106 holds the drawing board in its working position. A hard, flat surface 108 is presented on one side of the drawing board, while the opposite or bottom side of the drawing board is provided with a recess 110 which normally receives a mat board (not shown). Drawing can be performed either on surface 108 or the drawing board can be removed, inverted and replaced with the mat board facing upwardly to provide a surface upon which drawing can be performed. An alternative manner of using drawing board 104 is to completely remove it and rotate it 90° so that its long axis extends from front to back. The board can then be placed on the upper section 14 in this position and held by a clamp, latch or other suitable device (not shown). This orients the board for drawing with the long axis of the paper positioned to draw upright figures and the like. The near edge of the drawing board is then located adjacent wall 34 rather than being spaced therefrom to expose compartments 96, and the drawing supplies in drawer 88 can be used.

A thin cover 112 normally overlies drawing board 104 to protect the drawing board in the closed or storage position thereof. The drawing board and cover slide in and out of section 14 beneath metal flanges 114 secured to the upper edges of the side walls 40 and 42. Flanges 114 are turned downwardly at their rearward ends adjacent to the back wall 34 of section 14. The downturned portions form stops 116 which prevents drawing board 104 and cover 112 from sliding out the back of section 14. Drawing board 104 and cover 112 are preferably held in their closed position by suitable latches (not shown).

The present invention includes a reversible hinge arrangement which permits the upper section 14 to be hingedly connected to either the back wall of section 12 as shown in FIG. 1 or the front wall of section 12 as shown in FIG. 2. The front wall 16 of lower section 12 is provided with a pair of spaced apart hinge barrels 118 which are identical to the hinge barrels 32 on the back wall. As previously indicated, the hinge pins 36 on the upper section 14 can be removed from hinge barrels 32 and can be inserted in the other pair of hinge barrels 118, thus connecting the back wall 34 of upper section 14 with front wall 16 of the lower section 12. In this manner, the upper section can be connected with the lower section for hinged movement about the axis defined by the mating connection of hinge pins 36 in barrels 118. This hinged connection permits the upper section to be raised until the drawing board 104 is oriented at the desired inclination for making drawings and sketches. The upper section can be maintained at the desired position by pivoting a pair of props 120 upwardly. The props 120 are pivotally connected with the opposite side walls 20 and 22 of the lower section and can be pivoted downwardly to stored positions within the large storage compartment 28.

The portable easel device 10 can be supported at an elevated position by a tripod arrangement which includes three legs 122. One leg connects with side wall 20 of the lower section 12, another leg connects with the opposite side wall 22, and the third leg connects with the center of the back wall 18 of the lower section. All of the legs 112 are constructed identically; therefore, only one of the legs will be described in detail.

Figure 4:
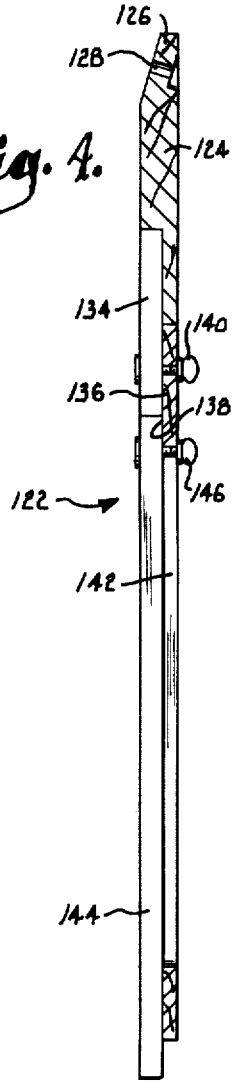
FIG. 4 is a cross sectional view of one of the legs of the portable easel device.

Referring now to FIG. 4 in particular, each leg 122 has an upper section 124. Section 124 is beveled at its upper end as indicated at 126, and the beveled end 126 is provided with a counterboard opening 128. The beveled upper ends of the legs are received in respective grooves 130 (see FIGS. 1 and 2) formed in the side walls and rear wall of the lower section 12. A screw 132 is extended through opening 128 and is threaded into the lower section 12 of the carrying case in order to secure the upper leg section 124 thereto with the leg extending downwardly and somewhat outwardly from the carrying case. The upper section 124 of each leg has a downwardly projecting tongue 134 which is reduced in size and which extends downwardly from the leg section. Tongue 134 is substantially square in section.

Each leg 22 has an intermediate section 136 which can be connected with the lower end of section 124. A groove 138 is formed in intermediate section 136 and extends the entire length thereof. Groove 138 has a size and shape to closely receive the projecting tongue 134 of the upper leg section. A screw 140 may be threaded through section 136 and into tongue 134 in order to connect leg sections 124 and 136 end to end with tongue 134 fitting closely in groove 138. Intermediate leg section 136 is provided with an elongate slot 142 which intersects with groove 138. Slot 142 extends somewhat less than the length of leg section 136.

Each leg 122 further includes a lower leg section 144 which is slightly shorter than the intermediate section 136. The lower section 144 is square in section and has a size to fit closely in the groove 138 of the intermediate leg section. The lower section 144 may be extended and retracted in groove 138 relative to intermediate section 136 for adjustment of the length of the leg. A screw 146 is extended through slot 142 and is threaded into the lower leg section 144. By tightening screw 146, the lower section 144 is secured rigidly in place relative to the intermediate section 136. For adjustment of the length of the leg, screw 146 can be loosened and the lower section 144 can be extended or retracted before the screw is again tightened. In the fully retracted position shown in FIG. 4, the lower leg section 144 is contained almost entirely with the groove 138 of the intermediate section. All of the leg sections 124, 136, and 144 are short enough to fit within storage compartment 28 of the carrying case when disassembled.

In use, the portable easel device may be set up in the position shown in FIG. 1 to provide an easel for holding a painting canvas. In this position, the hinge pins 36 are inserted in hinge barrels 32 in order to connect the back end of upper section 14 with the back end of lower section 12. The canvas rest 52 is pivoted upwardly to its extended position, and the easel arm 60 is connected with arm 58. After adjusting the length of the easel arm such that it is disposed in the desired orientation, wing nut 70 is tightened and pin 86 is inserted through barrel 84. The rigid triangular framework formed by the upper and lower sections and the easel arm provides a sturdy easel stand for supporting the painting canvas (not shown). The canvas is installed on surface 52*a*, and its back surface rests on the easel arm 60. Bracket 76 is adjusted until its lower surface engages the upper edge of the canvas. It is pointed out that the painting supplies contained in compartments 24 are located immediately in front of the easel where they are conveniently accessible to the artist working from the front of the unit. Additionally, the oil paints contained in drawer 88 are conveniently located for access by the artist. Box 95 is oriented in drawer 88 such that compartment 95*c* and the oil paints contained therein are located toward the front of the device.

The portable easel device also provides a convenient drawing board when sketching or drawing is to be performed. To convert the device for drawing, the easel is disassembled and its components are stored in the lower section 12 of the carrying case. The upper section 14 is then shifted to the side to withdraw pins 36 from hinge barrels 32. After the upper section has been reversed, the hinge pins 36 are inserted in the hinge barrels 118 located on the front wall of the lower section. This connects the rear wall 34 of the upper section with the front wall 16 of the lower section as shown in FIG. 2. After upper section 14 has been raised about the hinge axis to the desired orientation, props 120 are raised to maintain the upper section in the desired position.

Cover 112 may be slid out of the upper section and the drawing board 104 is then slid out, inverted, and slid back into the upper section beneath flanges 114 such that recess 110 faces upwardly. The mat board (not shown) which is carried in the recess then faces upwardly to provide a surface upon which drawing or sketching can be performed. Normally, latches 106 are pivoted upwardly to hold the drawing board in the working position shown in FIG. 2. In this position, drawing board 104 is partially open to expose compartments 96 and the drawing supplies contained therein. It is pointed out that the compartments 96 are located immediately in front of the drawing board where they are readily accessible to the artist working from the front of the unit. Box 95 is oriented in drawer 88 to locate compartment 95*b* and the drawing supplies contained therein toward the front of the device where they are conveniently accessible. As indicated previously, drawing board 104 can be removed and turned 90° from the position shown in FIG. 2 and held on top of upper section 14 by a clamp or latch (not shown). In this situation, the drawing board substantially covers compartments 96 and the drawing supplies in compartment 95*b* of the box 95 are used.

The device can be supported on legs 122 when serving either as an easel or as a drawing board. Alternatively, the lower section 12 can rest on a table or similar surface if desired. When supported on the legs, the elevation of the device can be adjusted by extending or retracting the lower leg sections 144. Thus, the device can be located at the proper elevation to permit the artist to either stand or sit at it. The male-female joint provided by the close fit of tongue 134 in groove 138 strengthens the connection between the upper and intermediate leg sections to enhance the strength and stability of the legs. The provision of an upper leg section 124 which is separate from the intermediate section 136 permits the device to normally be used without the lower leg sections 144 extended significantly from the retracted position. Consequently, the overall stability of the device when supported on the legs is improved. At the same time, the multipart leg construction permits the legs to be disassembled and easily stored within the carrying case since none of the leg sections are unduly long.

When not in use, all of the components of the portable easel device can be stored within the carrying case. Drawing board 108 is completely closed to cover compartments 96 and 100 and the contents thereof, and cover 112 is positioned in covering relation to the drawing board. The drawing board and cover are held in the closed position by suitable latches (not shown). The easel can be broken down by removing wing nut 70 to detach easel arm 60 from the canvas rest 52. The canvas rest is then pivoted downwardly to the storage position shown in broken lines in FIG. 3 wherein it is entirely contained within the lower section 12, with arm 58 being received in notches 26*a*. The nut which is threaded onto screw 74 is loosened sufficiently to permit the easel arm sections 62 and 64 to be folded alongside one another such that the folded easel arm can then be inserted into compartment 28 for storage. Drawer 88 is pushed inwardly to its closed position and is preferably held in the closed position by a suitable latch (not shown). Preferably, compartment 95*c* is folded up to enclose the oil paints contained therein.

Legs 122 are disassembled by removing screws 132 to detach the legs from the case. Screw 140 of each leg is then removed to separate the upper and intermediate leg sections. The lower leg section 144 is moved to its retracted position within groove 138, and the disassembled legs are stored in the large storage compartment 28 in the lower section of the case.

When all of the components of the device have been positioned in the case in their storage position, the upper section 14 is closed on the lower section, and latches 46 are used to secure the case in its closed condition. Handle 50 provides a convenient means for carrying the case. It is pointed out that the stops 94 and 116 prevent drawer 88 and the drawing board and cover from sliding out of the device as it is being carried. All of the components of the easel and legs can be easily stored in the case, along with all of the required painting and drawing supplies.

It is thus apparent that the present invention provides a device which serves alternately as an easel and as a drawing board and which provides a convenient carrying case in which all of the components and all of the necessary art supplies can be carried. It is again pointed out that the painting supplies are conveniently located (in compartments 24 and 95*c*) when the device is serving as an easel and that the drawing supplies are conveniently located (in compartments 96 and 95*b*) when the device is serving as a drawing board. Both painting and drawing are carried out from the front of the device, and the legs 122 do not interfere with the artist since the rear leg is located in the center of the back wall of lower section 12 where it is remote from the artist. In addition, the improved leg structure provides increased strength and stability due to the male-female joint between the upper and intermediate leg sections, while at the same time permitting the legs to be quickly and easily disassembled and stored in the case. To facilitate connection and disconnection of the parts a specal tool (not shown) can be used, with the tool having a screwdriver blade for tightening and loosening the screws and a slot for tightening and loosening the wing nuts.

The sliding drawer 88 normally receives the transparent panel 90, a border for a picture or painting, the picture or painting face down, and a mat backing on top of the picture or painting. The picture or painting is thus displayed in an attractive manner on the bottom of the case. On top of the mat backing is a supply of drawing paper, while a cardboard panel is preferably positioned on top of the drawing paper and beneath the removable box 95.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the score of the claims.

Since many possible embodiments may be made of the invention without department from the scope thereof, it is to be understood that all matter herein set forth or shown in the accompanying drawings is to be interpreted as illustrative and not in a limiting sense.

Having described the invention, I claim:

1. A portable easel arrangement comprising:

a carrying case having a lower section presenting a plurality of compartments for holding art supplies;

an upper section of the carrying case coupled with said lower section for hinged movement between an open position wherein said compartments are accessible and a closed position wherein the upper section covers the lower section;

a canvas rest mounted in said lower section for pivotal movement between a folded storage position wherein the canvas rest is contained in the lower section of the case and an extended position wherein the canvas rest presents a surface thereon for receiving the lower edge of a painting canvas;

an easel arm adapted for detachable connection to said canvas rest in generally upward extension therefrom to receive the back of a painting canvas resting on the canvas rest, said arm fitting in said carrying case for storage when detached from the canvas rest; and means for detachably fastening a selected portion of said easel arm to said upper section in the open position of the latter to maintain said arm in a generally vertical orientation for receiving the back of a canvas resting on said canvas rest, said detachable fastening means holding said upper section and said canvas rest and easel arm rigidly in place in a configuration wherein said upper and lower sections and said easel arm cooperate to form a rigid triangular structure for supporting the painting canvas.

2. The invention set forth in claim 1, including means for adjusting the length of said easel arm to vary the effective length thereof between said canvas rest and said selected portion of the easel arm, thereby adjusting the inclination of said easel arm relative to vertical.

3. The invention set forth in claim 1, including a bracket on said easel arm for engaging the upper edge of the canvas, said bracket being adjustable along the length of said easel arm.

4. The invention set forth in claim 1, including a sliding drawer on said lower section supported thereon for sliding movement between an open position wherein access is provided to the contents of the drawer and a closed position wherein the drawer is retracted within the lower section, said drawer being adapted to hold art supplies.

5. The invention set forth in claim 1, including an arm portion of said canvas rest projecting therefrom in a direction generally perpendicular to said surface of the canvas rest, said arm portion fitting in said lower section in the storage position of said canvas rest, said easel arm being adapted for detachable connection to said arm portion of the canvas rest to form a continuation thereof.

6. The invention set forth in claim 1, wherein said easel arm is constructed of a pair of arm sections secured together in a substantially straight condition and foldable generally alongside one another for storage in said carrying case.

7. The invention set forth in claim 1, including:

a plurality of compartments in said upper section of the case for holding drawing supplies; and a drawing board on said upper section supported thereon for sliding movement between a storage position wherein the compartments in said upper section are covered by the drawing board and a working position wherein the compartments in said upper section are accessible.

8. The invention set forth in claim 1, including a plurality of legs adapted to be detachably connected with said lower section to support same at an elevated position, each leg being expansible to vary the length thereof and the elevation of said lower section and each leg being constructed to fit in said carrying case when detached from said lower section.

9. A combined drawing board and easel arrangement comprising:

a carrying case having upper and lower sections, said lower section being adapted to hold art supplies and having front and back ends;

a drawing board on said upper section;

first hinge means for detachably connecting said upper section to the back end of said lower section in a manner permitting hinged movement of the upper section about a first hinge axis between an open position wherein the interior of said lower section is exposed and a closed position wherein the upper section covers the lower section;

an easel adapted to be set up in said lower section when said upper section is in the open position, said easel being adapted to support a painting canvas to permit painting on the canvas from the front end of said lower section; and second hinge means for detachably connecting said upper section to said front end of the lower section in a manner permitting hinged movement of the lower section about a second hinge axis offset from and generally parallel to said first hinge axis, said upper section being movable about said second hinge axis to a position to orient said drawing board in an inclined position, thereby permitting drawing on the drawing board from said front end of the lower section.

10. The invention set forth in claim 9, including:

opposite sides of said lower section of the carrying case; and a tripod leg arrangement including a pair of legs adapted for detachable connection to said opposite sides of the lower section and a third leg adapted for detachable connection to said back end of the lower section to support same in an elevated position, whereby painting on the easel and drawing on the drawing board can be accomplished from said front end of the lower section without interference from the legs.

11. The invention set forth in claim 9, wherein said first detachable hinge means includes a first hinge component on one end of the upper section and a second hinge component on said back end of the lower section adapted to mate with said first hinge component, said front end of the lower section having a third hinge component thereon adapted to mate with said first hinge component to provide said second detachable hinge means.

12. The invention set forth in claim 9, including a cover panel carried on said upper section for sliding movement thereon, said cover panel being adapted to cover said drawing board in overlying relation thereto.

13. The invention set forth in claim 9, wherein said easel includes:

a canvas rest mounted in said lower section for pivotal movement between a storage position wherein the canvas rest is folded into said lower section and an extended position wherein said canvas rest presents a surface adapted to receive the lower edge of the painting canvas;

an easel arm adapted for detachable connection to said canvas rest in the extended position thereof; and means for detachably fastening a selected portion of said easel arm to said upper section in the open position of the latter to maintain said arm in a generally vertical orientation, with said lower section, upper section and easel arm cooperating to form a generally triangular framework for supporting the canvas.

14. The invention set forth in claim 9, including:

a plurality of compartments in said lower section for holding painting supplies at an accessible location forwardly of said easel when said upper section is in the open position;

a plurality of compartments in said upper section for holding drawing supplies; and means mounting said drawing board on the upper section for sliding movement between a storage position wherein the compartments of said upper section are covered by the drawing board and a working position wherein said compartments of the upper section are exposed at an accessible location adjacent the drawing board.

15. The invention set forth in claim 9, including:

a drawer supported on said lower section for sliding movement into and out of the lower section from said front end thereof;

a box adapted for removable insertion in said drawer;

a first compartment in said box for holding painting supplies; and a second compartment in said box for holding painting supplies, said first compartment being located toward said front end of the lower section in a first orientation of the box in said drawer and said second compartment being located toward said front end of the lower section in a second orientation of the box in said drawer, whereby either the first or second compartment can be exposed when the drawer projects partially out of the lower section.

16. In a portable easel arrangement of the type having a carrying case for art supplies, an easel adapted to be set up in the carrying case to hold a painting canvas, and a plurality of legs for supporting the case at an elevated position, an improved construction for each leg comprising:

an upper leg section adapted to be detachably connected to the carrying case and short enough to fit therein for storage, said upper leg section having a tongue portion projecting downwardly therefrom;

an intermediate leg section presenting a groove therein sized to closely receive said tongue portion of the upper leg section, said intermediate leg section being short enough to fit in the carrying case for storage;

means for detachably securing said upper and intermediate leg sections together end to end with said tongue portion of the upper section disposed in said groove to strengthen the connection between the upper and intermediate leg sections;

a lower leg section sized to fit closely in said groove and short enough to be contained substantially completely in the groove for storage, said lower leg section being extensible and retractable in said groove to vary the length of the leg; and releasable means for securing said lower leg section to said intermediate leg section with the lower section projecting out of the groove below the intermediate section, said releasable means being selectively releasable to permit adjustment of the length of the leg and retraction of the lower leg section into said groove for storage.

* * * * *